US010790640B2

(12) United States Patent
Shibata

(10) Patent No.: US 10,790,640 B2
(45) Date of Patent: Sep. 29, 2020

(54) SPARK PLUG FOR INTERNAL COMBUSTION ENGINE

(71) Applicant: DENSO CORPORATION, Kariya, Aichi-pref. (JP)

(72) Inventor: Masamichi Shibata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/768,106

(22) PCT Filed: Sep. 9, 2016

(86) PCT No.: PCT/JP2016/076608
§ 371 (c)(1),
(2) Date: Apr. 13, 2018

(87) PCT Pub. No.: WO2017/064957
PCT Pub. Date: Apr. 20, 2017

(65) Prior Publication Data

US 2018/0309270 A1 Oct. 25, 2018

(30) Foreign Application Priority Data

Oct. 14, 2015 (JP) ..... 2015-203199

(51) Int. Cl.
*H01T 13/36* (2006.01)
*H01T 13/38* (2006.01)
*H01T 13/34* (2006.01)

(52) U.S. Cl.
CPC ..... *H01T 13/36* (2013.01); *H01T 13/34* (2013.01); *H01T 13/38* (2013.01)

(58) Field of Classification Search
CPC ..... H01T 13/38; H01T 13/34; H01T 13/36
See application file for complete search history.

(56) References Cited

U.S. PATENT DOCUMENTS 6,111,345 A 8/2000 Shibata et al.
6,170,451 B1 1/2001 Moriya
2008/0284305 A1* 11/2008 Hoffman ..... H01T 13/34 313/141

(Continued)

FOREIGN PATENT DOCUMENTS

EP 1098404 A1 * 5/2001 ..... H01T 13/14
JP 2001-203059 7/2001
JP 3215490 10/2001

(Continued)

*Primary Examiner* — Joseph L Williams
*Assistant Examiner* — Jacob R Stern
(74) *Attorney, Agent, or Firm* — Nixon & Vanderhye PC

(57) ABSTRACT

In a spark plug for an internal combustion engine, an insulator is held inside a housing such that a proximal end thereof projects in an axial direction. A center electrode is held inside the insulator such that a distal end thereof projects. A terminal fitting is connected to the proximal end of the insulator and provided such that electricity is conducted between the center electrode and the terminal fitting. A ground electrode forms a spark discharge gap between the distal end of the center electrode and the ground electrode. A first gap is formed between the proximal end of the insulator and the terminal fitting, a second gap is formed between a proximal end of the housing and the insulator, and at least one of the first gap and the second gap is filled with a filler.

3 Claims, 4 Drawing Sheets

(56) References Cited

U.S. PATENT DOCUMENTS

| | | | | |
|---|---|---|---|---|
| 2011/0043094 | A1* | 2/2011 | Suzuki | H01T 13/36<br>313/144 |
| 2014/0210336 | A1 | 7/2014 | Yamada et al. | |

FOREIGN PATENT DOCUMENTS

| | | |
|---|---|---|
| JP | 2003-045609 | 2/2003 |
| JP | 2013-16295 | 1/2013 |

* cited by examiner

SPARK PLUG FOR INTERNAL COMBUSTION ENGINE

CROSS-REFERENCE TO RELATED APPLICATION

This application is the U.S. national phase of International Application No. PCT/JP2016/076608 filed Sep. 9, 2016, which designated the U.S. and claims priority to Japanese Patent Application No. 2015/203,199 filed on Oct. 14, 2015, the entire contents of each of which are hereby incorporated herein by reference.

TECHNICAL FIELD

The present disclosure relates to a spark plug for an internal combustion engine.

BACKGROUND ART

A spark plug is conventionally used as an ignition device for an internal combustion engine. In a high discharge voltage environment, the spark plug is liable to suffer from what is called flashover, i.e., creepage insulation breakdown that occurs between a proximal end of an insulator and a terminal fitting of a plug head or between a proximal end of a housing and the insulator. If a flashover occurs, spark discharge does not occur at the distal end of the plug, inhibiting fuel gas from being ignited.

Flashover at the spark plug occurs in the following manner. When a high voltage is applied to a center electrode, the electric field is concentrated at an air space formed in a gap between the terminal fitting and the proximal end of the insulator, causing negative corona discharge. Similarly, the electric field is concentrated at an air space formed in a gap between the proximal end of the housing and the insulator, causing positive corona discharge. After that, if the application of high voltage is further continued, the positive corona discharge becomes creeping streamers and moves to the negative side. The creeping streamers then reach the negative corona discharge, thereby causing a short circuit and creeping discharge, namely, flashover.

As a conventional technique for suppressing the occurrence of such flashover, PTL 1 discloses a configuration for reducing the eccentricity or bending of a terminal fitting of a plug head by inclining an abutment surface of the terminal fitting in accordance with the inclination of a proximal end of an insulator. Consequently, the creeping distance between the center electrode and the terminal fitting along the surface of the insulator is extended, so that the creeping streamers have difficulty reaching the negative corona discharge, and the occurrence of flashover is suppressed.

CITATION LIST

Patent Literature

[PTL 1] JP 2003-45609 A

SUMMARY OF THE INVENTION

In the configuration disclosed in PTL 1, when axial pressure is applied to the terminal fitting for fusing the insulator and the terminal fitting together, radially-extending force is liable to be exerted on the proximal end of the insulator to cause the breakage of the insulator. Therefore, there is room for improvement.

An object of the present disclosure is to provide a spark plug for an internal combustion engine that suppresses the occurrence of flashover and prevents the breakage of an insulator.

A spark plug for an internal combustion engine according to an aspect of the present disclosure includes:

a housing having a cylindrical shape; an insulator having a cylindrical shape and held inside the housing such that a proximal end projects in an axial direction;

a center electrode held inside the insulator such that a distal end projects in the axial direction;

a terminal fitting connected to the proximal end of the insulator and provided such that electricity is conducted between the center electrode and the terminal fitting; and a ground electrode fixed to a distal end of the housing and forming a spark discharge gap between the distal end of the center electrode and the ground electrode, and a first gap is formed between the proximal end of the insulator and the terminal fitting, a second gap is formed between a proximal end of the housing and the insulator, and at least one of the first gap and the second gap is filled with a filler.

In the spark plug for an internal combustion engine, at least one of the first gap and the second gap is sealed with the filler, preventing the formation of an air space in the gap. As a result, ionization of the air space due to the concentration of the electric field at the gap is suppressed when a high voltage is applied to the center electrode, and the occurrence of corona discharge is suppressed. Therefore, the occurrence of flashover resulting from the occurrence of corona discharge is also suppressed. In addition, since this configuration eliminates the need to incline the abutment surface of the terminal fitting in accordance with the inclination of the proximal end of the insulator, the insulator is prevented from being broken when the insulator and the terminal fitting are fused together.

As described above, the present disclosure can provide the spark plug for an internal combustion engine that suppresses the occurrence of flashover and prevents the breakage of the insulator.

BRIEF DESCRIPTION OF DRAWINGS

The above and other objects, characteristics, and advantages of the present disclosure will be further clarified in the following detailed description with reference to the accompanying drawings, in which.

DESCRIPTION OF EMBODIMENT

First Embodiment

Figure 1:
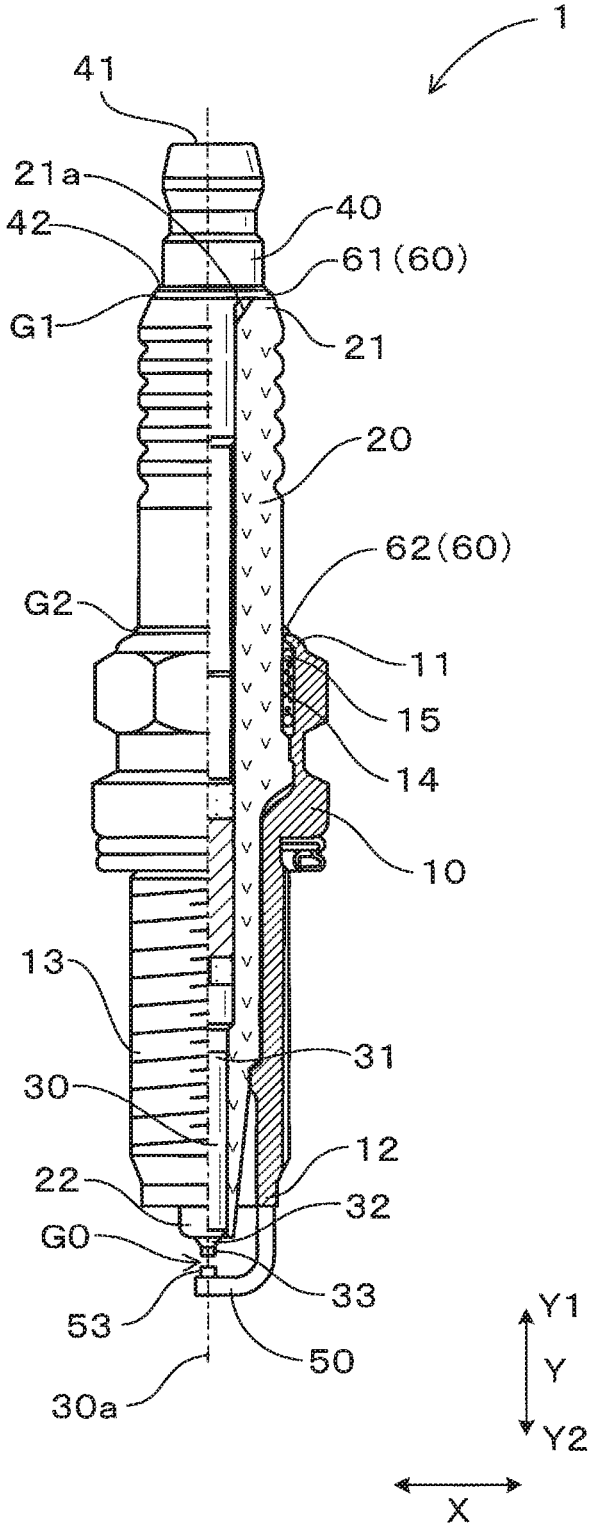
FIG. 1 is a front partial cross-sectional view of a spark plug according to a first embodiment.

An embodiment of a spark plug for an internal combustion engine will be described using FIGS. 1 to 3.

The spark plug 1 for an internal combustion engine according to the present embodiment includes a housing 10, an insulator 20, a center electrode 30, a terminal fitting 40, and a ground electrode 50.

The housing 10 has a cylindrical shape.

The insulator 20 has a cylindrical shape and held inside the housing 10 such that a proximal end 21 of the insulator 20 projects.

The center electrode 30 is held inside the insulator 20 such that a distal end 32 of the center electrode 30 projects.

The terminal fitting 40 is connected to the proximal end 21 of the insulator 20 and provided such that electricity is conducted between the center electrode 30 and the terminal fitting 40.

The ground electrode 50 is fixed to a distal end 12 of the housing 10 and forms a spark discharge gap G0 between the distal end 32 of the center electrode 30 and the ground electrode 50.

A first gap G1 is formed between the proximal end 21 of the insulator 20 and the terminal fitting 40, a second gap G2 is formed between a proximal end 11 of the housing 10 and the insulator 20, and at least one of the first gap G1 and the second gap G2 is filled with a filler 60.

Hereinafter, the spark plug 1 for an internal combustion engine according to the present embodiment will be described in detail. Note that the spark plug 1 for an internal combustion engine is hereinafter also referred to as the "spark plug 1".

The spark plug 1 can be used as an ignition means for an internal combustion engine provided in a car or the like. One side of the spark plug 1 which is inserted into a combustion chamber (not illustrated) is referred to as a distal end side, and the end of the distal end side is referred to as a distal end. Similarly, the side opposite to the distal end side is referred to as a proximal end side, and the end of the proximal end side is referred to as a proximal end. In the present description, a plug axial direction Y means the axial direction of the spark plug 1. In the plug axial direction Y, a direction from the distal end toward the proximal end is referred to as a proximal end direction Y1, and a direction from the proximal end toward the distal end is referred to as a distal end direction Y2.

As illustrated in FIG. 1, the housing 10 is made of metal and has a cylindrical shape extending in the plug axial direction Y. An attachment screw 13 is formed on an outer peripheral surface of the housing 10 so as to be screwed with an internal combustion engine (not illustrated). The spark plug 1 is attached to the internal combustion engine via the attachment screw 13. The insulator 20 is inserted into and held inside the housing 10.

As illustrated in FIG. 1, the insulator 20 has a cylindrical shape extending in the plug axial direction Y. The proximal end 21 of the insulator 20 projects from the proximal end 11 of the housing 10. An inclined surface 21*a* is formed inside the proximal end 21 of the insulator 20. As illustrated in FIG. 3, the proximal end 11 of the housing 10 is swaged via talc 14 and an O-ring 15 substantially in the middle of the plug axial direction Y, whereby the insulator 20 is held by the housing 10.

As illustrated in FIG. 1, the center electrode 30 is inserted into and held inside the insulator 20. The center electrode 30 has a rod shape extending in the plug axial direction Y. A center electrode side metal tip 33 is attached to the distal end 32 of the center electrode 30 and projects from a distal end 22 of the insulator 20.

As illustrated in FIG. 1, the terminal fitting 40 is provided at the proximal end 21 of the insulator 20. The terminal fitting 40 is electrically connected to a proximal end 31 of the center electrode 30 inserted into and held inside the insulator 20, and configured such that electricity is conducted between the center electrode 30 and the terminal fitting 40. The terminal fitting 40 is fused with and fixed to the proximal end 21 of the insulator 20. A proximal end 41 of the terminal fitting 40 is electrically connected to the secondary side of an ignition coil of an ignition device (not illustrated).

As illustrated in FIG. 1, the ground electrode 50 extends from the distal end 12 of the housing 10 in the plug axial direction Y and is bent to cross an axial center 30*a* of the center electrode 30. The ground electrode 50 is provided with a ground electrode side metal tip 53 at a position facing the center electrode side metal tip 33. The center electrode side metal tip 33 and the ground electrode side metal tip 53 are spaced apart from each other by a predetermined distance, so that the spark discharge gap G0 is formed.

Figure 2:
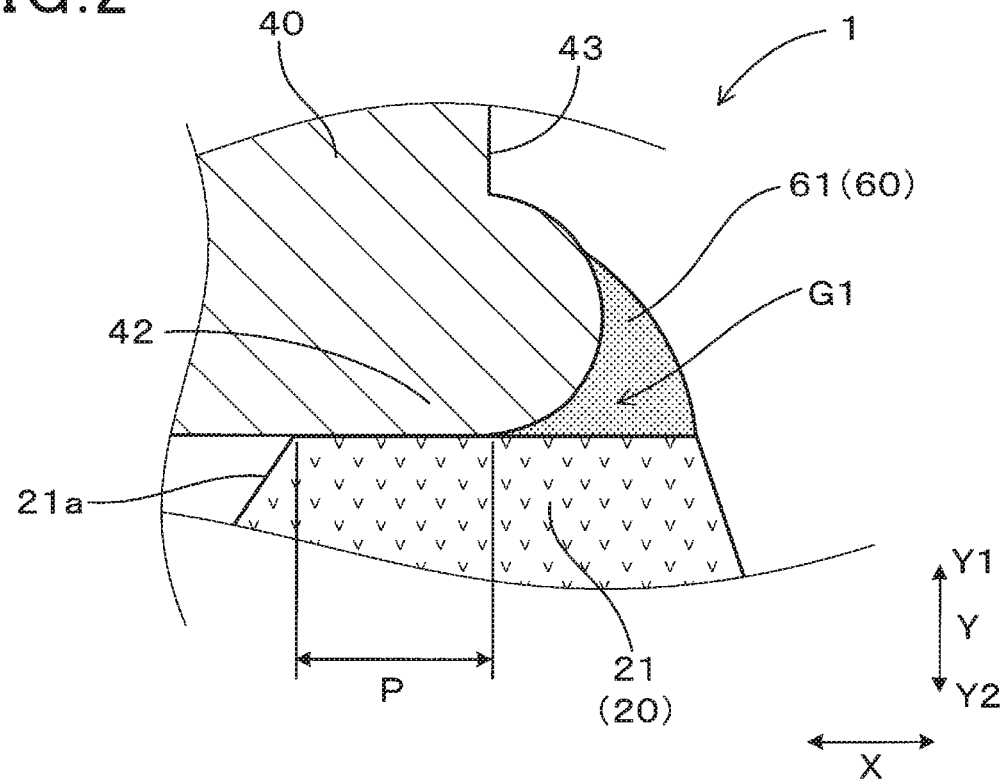
FIG. 2 is a cross-sectional partial enlarged view of the area near a first gap of the spark plug according to the first embodiment.

As illustrated in FIG. 2, the terminal fitting 40 has a facing part 42 that faces the proximal end 21 of the insulator 20. The proximal end 21 of the insulator 20 and the facing part 42 of the terminal fitting 40 are in contact with each other in a region P extending in the entire circumferential direction. In a region extending outward from the region P in a radial direction X, the first gap G1 is formed between the proximal end 21 of the insulator 20 and the facing part 42 of the terminal fitting 40.

The first gap G1 is filled with a first filler 61. As illustrated in FIG. 1, the entire circumferential area of the proximal end 21 of the insulator 20 is filled with the first filler 61. In the present embodiment, in order for the first gap G1 to be securely sealed, the first filler 61 is put in the entire area of the first gap G1 and also provided to form a small bulge on the first gap G1. The material for the first filler 61 is not particularly limited as long as the first gap G1 can be sealed therewith, and preferable examples thereof include insulating materials such as silicone resin, fluororesin, and epoxy resin. In the present embodiment, silicone resin is employed.

Figure 3:
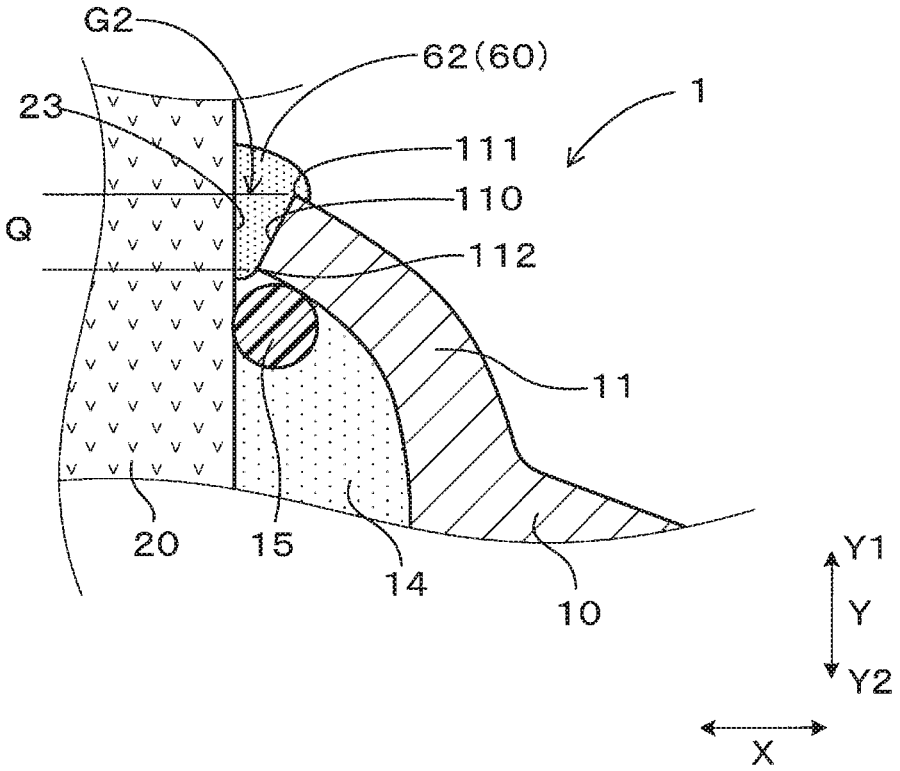
FIG. 3 is a cross-sectional partial enlarged view of the area near a second gap of the spark plug according to the first embodiment.

As illustrated in FIG. 3, the second gap G2 is formed between the proximal end 11 of the housing 10 and the insulator 20. The second gap G2 is a space formed in a region between an end surface 110 of the proximal end 11 of the housing 10 and a side surface 23 of the insulator 20, and in particular in a region Q extending in the plug axial direction Y from a proximal end side corner 111, i.e., the edge of the end surface 110 of the proximal end 11 on the proximal end side Y1, to a distal end side corner 112, i.e., the edge of the end surface 110 on the distal end side Y2.

In the present embodiment, the second gap G2 is filled with a second filler 62. The entire circumferential area of the proximal end 11 of the housing 10 is filled with the second filler 62. In this example, as illustrated in FIG. 3, the second filler 62 is provided on the proximal end side Y1 of the second gap G2 as well as in the second gap G2, so that the proximal end side corner 111 of the proximal end 11 is covered therewith.

As illustrated in FIG. 1, the spark plug 1 according to the present embodiment includes the above-mentioned first filler 61 and second filler 62 as the filler 60.

Next, the effect of the spark plug 1 according to the present embodiment will be described in detail.

In the spark plug 1, the first gap G1 and the second gap G2 are sealed with the first filler 61 and the second filler 62 serving as the filler 60, preventing the formation of air spaces in the first gap G1 and the second gap G2. As a result, ionization of the air spaces due to the concentration of the electric field at the first gap G1 and the second gap G2 is suppressed when a high voltage is applied to the center electrode 30, and the occurrence of corona discharge is suppressed. Therefore, the occurrence of flashover resulting from the occurrence of corona discharge is also suppressed. In addition, since this configuration eliminates the need to incline the facing part 42 of the terminal fitting 40 in accordance with the inclined surface 21*a* of the proximal end 21 of the insulator 20, the insulator 20 is prevented from being broken when the insulator 20 and the terminal fitting 40 are fused together.

In the present embodiment, the filler 60 is made of an insulating resin. Therefore, insulation is secured in the first gap G1 and the second gap G2, whereby the occurrence of flashover is further suppressed.

In the present embodiment, both the first gap G1 and the second gap G2 are filled with the filler 60. Consequently, the occurrence of flashover can be effectively prevented.

Note that at least the second gap G2 may be filled with the second filler 62 serving as the filler 60. In this case, since the occurrence of positive corona discharge is suppressed, the occurrence of creeping streamers is suppressed. Therefore, the effect of preventing the occurrence of flashover can be ensured.

In the present embodiment, the second filler 62 serving as the filler 60 covers the proximal end side corner 111 of the housing 10. Consequently, the occurrence of positive corona discharge is suppressed at the part between the proximal end side corner 111 and the side surface 23 of the insulator 20 as well as at the second gap G2, and the occurrence of creeping streamers is further suppressed. Therefore, the occurrence of flashover is further prevented.

Note that at least the first gap G1 may be filled with the first filler 61 serving as the filler 60. In this case, since the occurrence of negative corona discharge is suppressed at the first gap G1, the effect of suppressing the occurrence of flashover can be achieved.

Figure 4:
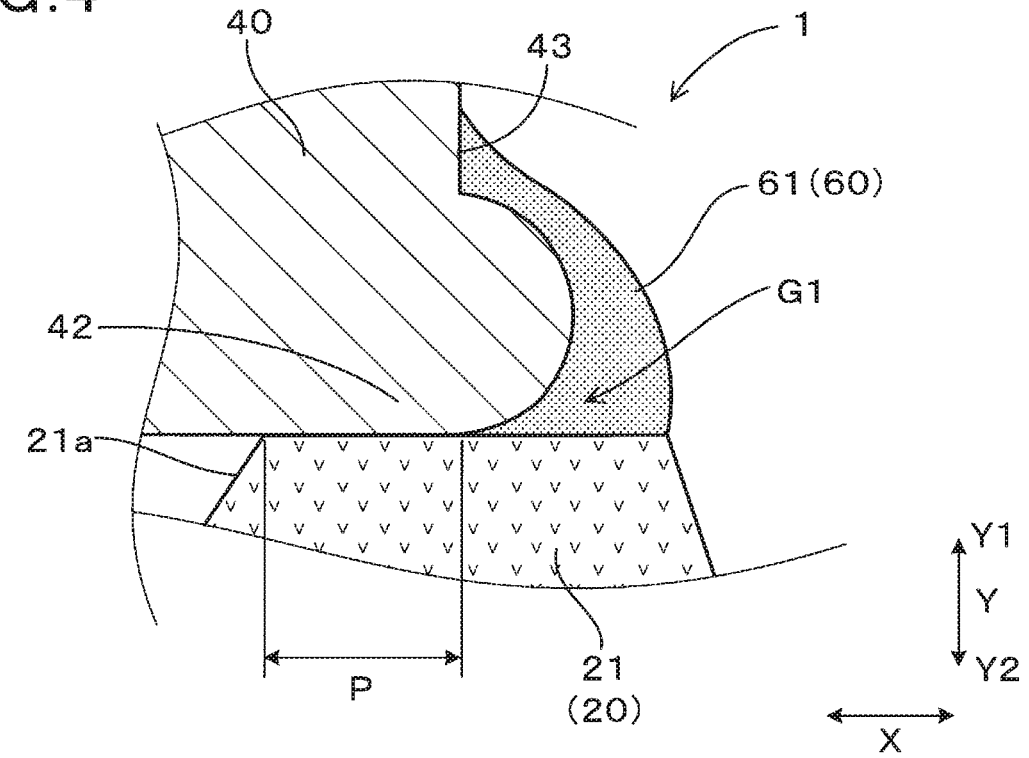
FIG. 4 is a cross-sectional partial enlarged view of the area near the first gap of the spark plug according to a first modification.

As can be seen in FIG. 4 illustrating the spark plug 1 according to a first modification, the first filler 61 put in the first gap G1 may further cover a part of a distal end side surface 43 of the terminal fitting 40. In this case, the occurrence of negative corona discharge can be further suppressed at the part between the distal end side surface 43 of the terminal fitting 40 and the proximal end 21 of the insulator 20, and the occurrence of flashover can be further suppressed.

Figure 5:
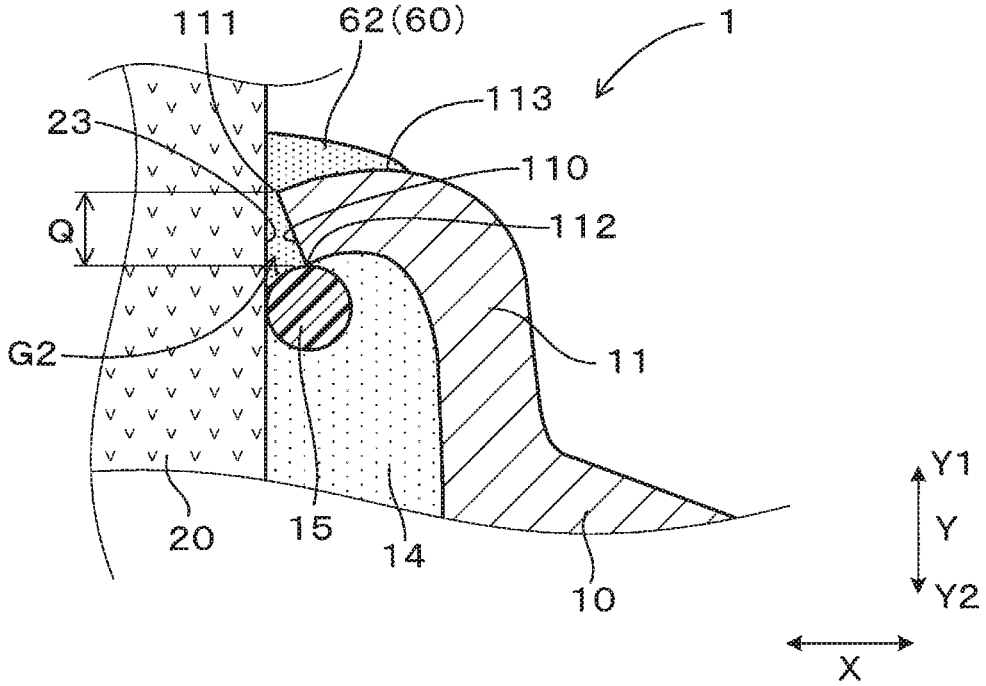
FIG. 5 is a cross-sectional partial enlarged view of the area near the second gap of the spark plug according to a second modification.

As can be seen in FIG. 5 illustrating the spark plug 1 according to a second modification, the proximal end 11 of the housing 10 may be swaged such that it is folded toward the distal end side Y2, that is, toward the O-ring 15. In addition, as illustrated in FIG. 5, the second filler 62 serving as the filler 60 is provided to cover not only the second gap G2 but also a proximal end side endmost part 113 of the proximal end 11 located on the proximal end side Y1 relative to the proximal end side corner 111 in the plug axial direction Y.

Consequently, even though the proximal end 11 is formed in a folded manner as described above, the occurrence of positive corona discharge is further suppressed, and the occurrence of flashover can be further suppressed.

The present disclosure is not limited to the above-mentioned embodiment and modifications and can be applied to various embodiments without departing from the gist of the present disclosure. For example, the formation mode of the second filler 62 according to the first embodiment may be combined with the formation mode of the first filler 61 according to the first modification, or the formation mode of the first filler 61 according to the first embodiment may be combined with the formation mode of the second filler 62 according to the first modification. Alternatively, only one of either the first filler 61 or the second filler 62 may be provided.

(Evaluation Test)

In spark plugs for internal combustion engines according to the present disclosure, evaluation tests were conducted on Examples 1 to 3, in terms of the occurrence of flashover.

With regard to the spark plug of Example 1, the first gap G1 illustrated in FIG. 1 was filled with the first filler 61 serving as the filler 60, and the second gap G2 was not filled with the filler 60.

With regard to the spark plug of Example 2, the first gap G1 illustrated in FIG. 1 was not filled with the filler 60, and the second gap G2 was filled with the second filler 62 serving as the filler 60.

The spark plug of Example 3 had the same configuration as the spark plug of the above first embodiment, so that the first gap G1 and the second gap G2 were respectively filled with the first filler 61 and the second filler 62 serving as the filler 60 as illustrated in FIG. 1.

With regard to the spark plug for use as Comparative Example, neither the first gap G1 nor the second gap G2 was filled with the filler.

Note that the other configurations in Examples 1 to 3 and Comparative Example are equivalent to those in the above first embodiment.

The evaluation tests were conducted in the following manner. First, the distal end of each spark plug including the spark discharge gap G0 illustrated in FIG. 1 was immersed in insulating oil with the proximal end thereof exposed to the atmosphere, so that no discharge occurred at the spark discharge gap G0. Then, a high voltage was applied from an ignition coil (not illustrated) connected to the terminal fitting 40 at an applied frequency of 30 Hz. The applied voltage was gradually raised from 20 kV and measured a flashover voltage, the applied voltage at the time that a flashover occurred between the first gap G1 and the second gap G2.

Figure 6:
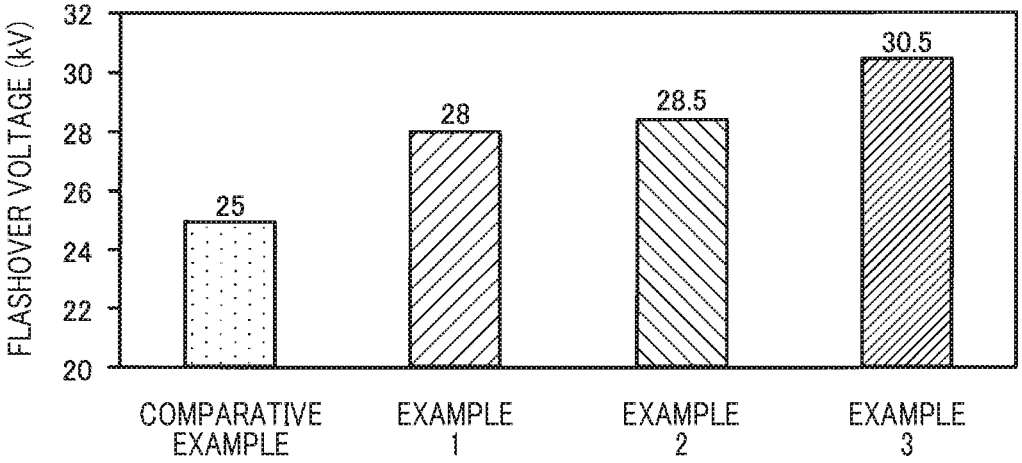
FIG. 6 is a diagram illustrating results of measuring flashover voltages in Examples 1 to 3 and Comparative Example.

As shown in FIG. 6, the flashover voltage of Comparative Example was 25 kV, whereas the flashover voltages of Examples 1 and 2 were 28 kV and 28.5 kV, respectively, which were higher than the flashover voltage of Comparative Example. Furthermore, the flashover voltage of Example 3 was 30.5 kV, which was higher than the flashover voltage of Comparative Example and also higher than the flashover voltages of Examples 1 and 2.

From the results of measurement mentioned above, it was confirmed that the flashover voltage, for the case where at least one of the first gap G1 and the second gap G2 was filled with the filler 60 as in Examples 1 to 3, was higher than that, for the case where neither the first gap G1 nor the second gap G2 was filled with the filler 60 as in Comparative Example, and the occurrence of flashover was more suppressed in the former case than in the latter case. It was also confirmed that the flashover voltage, for the case where both the first gap G1 and the second gap G2 were filled with the filler 60 as in Example 3, was even higher than that, for the case where only one of either the first gap G1 or the second gap G2 was filled with the filler 60 as in Examples 1 and 2, and the occurrence of flashover was even more suppressed in the former case than in the latter case.

It was also confirmed that the flashover voltage for the case where the second gap G2 was filled with the second filler 62 as in Example 2 was slightly higher than that for the case where the first gap G1 was filled with the first filler 61 as in Example 1, and the occurrence of flashover was slightly more suppressed in the former case than in the latter case.

The invention claimed is:

1. A spark plug for an internal combustion engine, the spark plug comprising:

a housing having a cylindrical shape;

an insulator having a cylindrical shape and held inside the housing such that a proximal end projects in an axial direction;

a center electrode held inside the insulator such that a distal end projects in the axial direction;

a terminal fitting connected to the proximal end of the insulator and provided such that electricity is conducted between the center electrode and the terminal fitting; and a ground electrode fixed to a distal end of the housing and forming a spark discharge gap between the distal end of the center electrode and the ground electrode, wherein:

a first gap formed between the proximal end of the insulator and the terminal fitting is filled with a first filler, the first filler covers a part of a distal end side surface of the terminal fitting;

a second gap formed between a proximal end of the housing and the insulator is also filled with a second filler;

the proximal end of the housing is swaged such that it is folded toward the distal end side; and the second filler is provided to cover a proximal end side endmost part of the housing located on the proximal end side of the housing relative to a proximal end side corner of the housing in the plug axial direction.

2. The spark plug for an internal combustion engine according to claim 1, wherein at least one filler selected from a group of the first and second fillers is made of an insulating resin.

3. The spark plug for an internal combustion engine according to claim 1, wherein the second filler covers the proximal end side corner of the housing.

* * * * *